US005912863A

United States Patent [19]

Bengtsson

[11] Patent Number: 5,912,863

[45] Date of Patent: Jun. 15, 1999

[54] ELECTRO-ACOUSTIC TRANSDUCER

[75] Inventor: Bo Bengtsson, Uppsala, Sweden

[73] Assignee: Cello, Limited, New Haven, Conn.

[21] Appl. No.: 08/793,175

[22] PCT Filed: Aug. 29, 1995

[86] PCT No.: PCT/SE95/00971

§ 371 Date: May 12, 1997

§ 102(e) Date: May 12, 1997

[87] PCT Pub. No.: WO96/07294

PCT Pub. Date: Mar. 7, 1996

[30] Foreign Application Priority Data

Aug. 29, 1994 [SE] Sweden ..... 9402871

[51] Int. Cl.[6] ..... H04R 23/00

[52] U.S. Cl. ..... 367/174; 367/175; 381/398; 381/399

[58] Field of Search ..... 381/158, 188, 381/192, 196, 199, 396, 398, 399; 367/140, 174, 175

[56] References Cited

U.S. PATENT DOCUMENTS 4,837,838 6/1989 Thigpen et al. ..... 381/158

*Primary Examiner*—J. Woodrow Eldred
*Attorney, Agent, or Firm*—Birch, Stewart, Kolasch & Birch, LLP

[57] ABSTRACT

An elongated, electrically conductive diaphragm is placed in a strongly magnetic field to produce a linear and an elongated sound source giving a high sound energy. At least two elongated diaphragms are positioned between intermediate and enclosing protected magnet elements, whereby the transverse length of the diaphragms are at least of the same size as that of the intermediate protected magnet elements. In this way, a sound without considerable interference merges at a short distance from the sources of the sound. By placing additional such sources of sound alongside each other, a broad sound source with a surface producing an essentially homogeneous sound field is achieved.

17 Claims, 4 Drawing Sheets

ELECTRO-ACOUSTIC TRANSDUCER

BACKGROUND OF THE INVENTION

1. Field of the Invention

This invention involves electro-acoustic transducers. The specific electro-acoustic transducers referred to produce a homogeneous high-power acoustic field from at least two linear sound sources or from a widespread area.

2. Description of the Relevant Art

Electrostatic speakers are known for producing a homogeneous sound field from an area. However, these have only been used to a limited extent. One reason for this is their restricted acoustic power per unit area.

SUMMARY OF THE INVENTION

By means of an elongated, electrically conductive diaphragm within a highly magnetic field, a linear source of sound, giving a high sound energy, is obtained. An least two elongated diaphragms with intermediate and enclosing elongated magnets are in accordance with the invention arranged in such a way that the transverse length of the diaphragms becomes at least the same as the transverse length of the intermediate elongated magnets. The sound from the two diaphragms will in this way merge without considerable interference at a short distance from the sound sources. By positioning several such sound sources side by side, a broad sound source with an area producing an esentially homogeneous acoustic field is acquired.

Such a broad sound source may be adjusted for the entire or part of the audio band of 0–50 kHz, without the requirement of a matching transformer or a crossover filter. This is possible through the diaphragms of conductive materials being electrically connected in series and/or in parallel, making the driving amplifier detect a primarily perfect resistance which may be varied optionally within the range of 2–90 Ohm, for example.

The area of the widespread sound source may be varied within a wide range to obtain the desired directional effect and characteristic. The sound source can accordingly be curved to partly or wholly form, for instance, a cylindric area, with the sound transmitter in the latter case acting as a radially pulsating cylinder for all the frecluences of the audio band, or optional parts thereof.

Further advantageous characteristics are evident from the patent claims and the detailed description of embodiments of the invention.

DETAILED DESCRIPTION OF THE INVENTION

Figure 1:
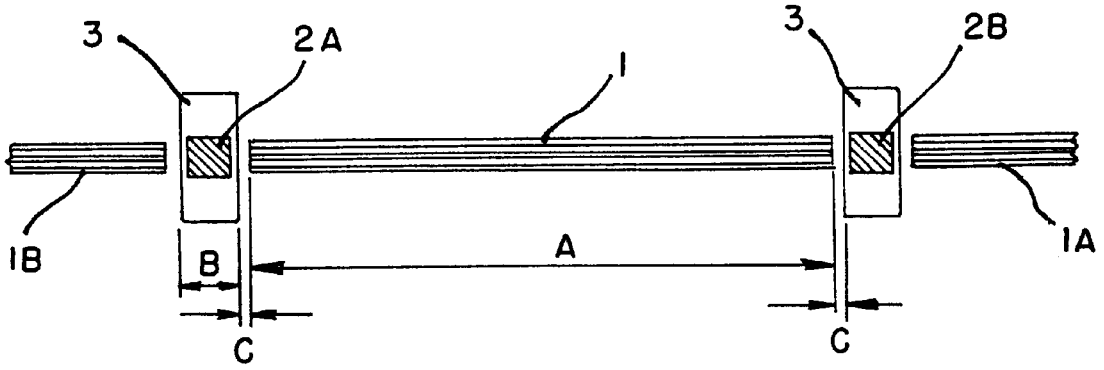
FIG. 1 shows schematically a cross-section of part of a device according to the invention.

One of the designs according to the invention is essentially made up of fundamentally linear and elongated sound sources as shown in cross-section in FIG. 1. A protected, electrically conductive diaphragm 1 is arranged in the gap between two elongated magnet elements 2A and 2B. In addition, similar diaphragms, 1A and 1B, may be arranged in gaps on opposite sides of the magnet elements. The protected magnet elements both have an elongated magnetic pole along one of the long sides of diaphragm 1 and an opposite magnetic pole along the other long side of diaphragm 1. In case electricity flows along the length of the diaphragm (into or out of the horizontal paper) the diaphragm will be influenced by a power across the diaphragm (upwards or downwards) depending on the direction of the current. When running a current of sound frequency, the entire length of the diaphragm functions as a loudspeaker diaphragm.

The magnetic elements 2A and 2B are positioned in protective bodies 3, giving mechanical support to the magnets which are effected by the same cross-power as diaphragm 1 when electricity flows in the diaphragm.

Figure 2:
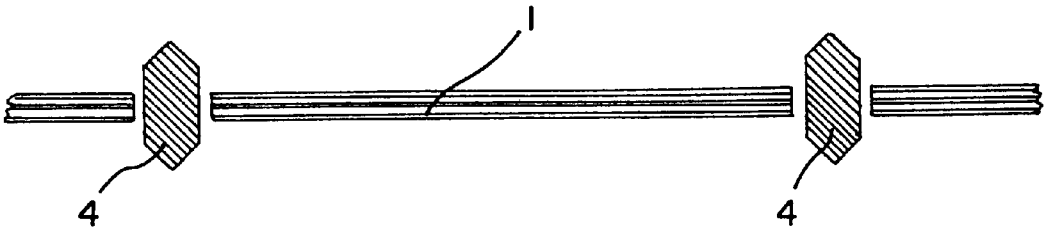
FIG. 2 shows an alternative arrangement.

The dimensioning of the diaphragms and the magnetic elements are of imperative significance in order to obtain a high sound effect and a homogeneous sound field. The magnets 2A and 2B ought to be permanent magnets, producing a powerful magnetic field. The relation between the width A of the diaphragm and the width B of the magnet and its supporting body 3 should be such that any significant interference between the sound waves from adjacent diaphragms is non-occurent. This condition is fulfilled if A is at least of the same size as B and preferably double the size. The distance C between the diaphragm and the magnet should be marginal, but large enough to give the diaphragm sufficient range when vibrating. To prevent the diaphragm from partly slipping outside the direct influence of the magnet elements during transport or otherwise, the bodies 3 may be fitted with guides, normally not touched by the diaphragms At the embodiment as shown in FIG. 2 the bodies 3 are eliminated through the magnets 4 being made of ceramic material, providing both sufficient magnetic field and an adequate mechanical durability and rigidity. The cross-section of the magnets 4 is designed so as not to have a negative affect on the sound field of the diaphragms.

Diaphragm 1 does preferably consist of a thin strip of aluminium, although it would be possible to use other suitable materials such as other types of metal or alloy, conductive plastics or combined materials.

Figure 3:
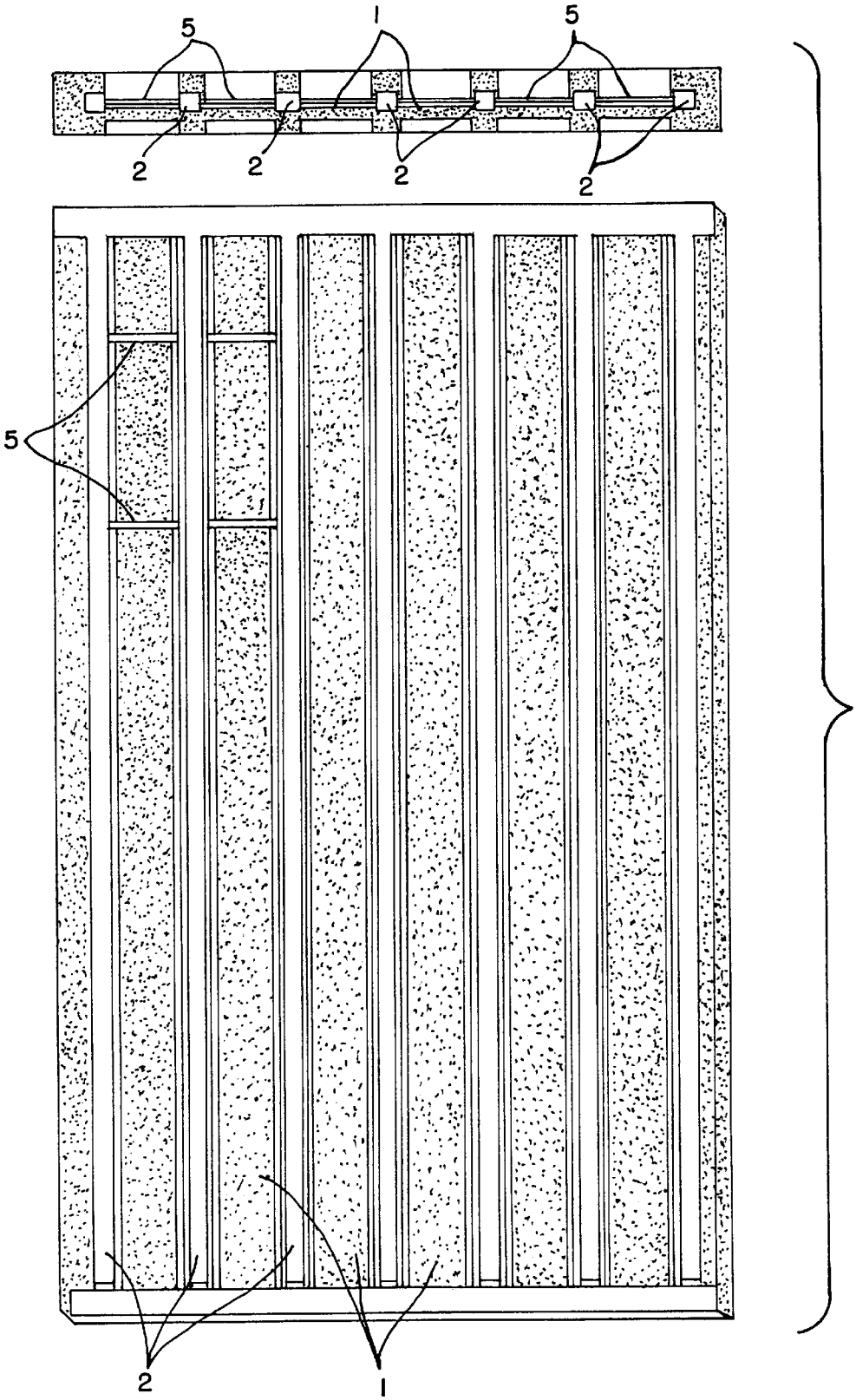
FIG. 3 shows schematically, seen from the front and from one end, a module of a plain unit according to the invention, containing six elongated diaphragms.

The plain sound module as shown in FIG. 3 has six diaphragms 1 positioned side by side, each enclosed by a magnet element 2. To keep the diaphragms in position, holders 5 in the form of nylon clips or similar are evenly arranged. Only four of these holders are shown in the drawing. Other devices may alternatively be used for this purpose, for example some type of elastic suspension devices. Each of the diaphragms ends are fixed to the end pieces of the module and have electrical attachments for optional connections in series or in parallel.

Figure 5:
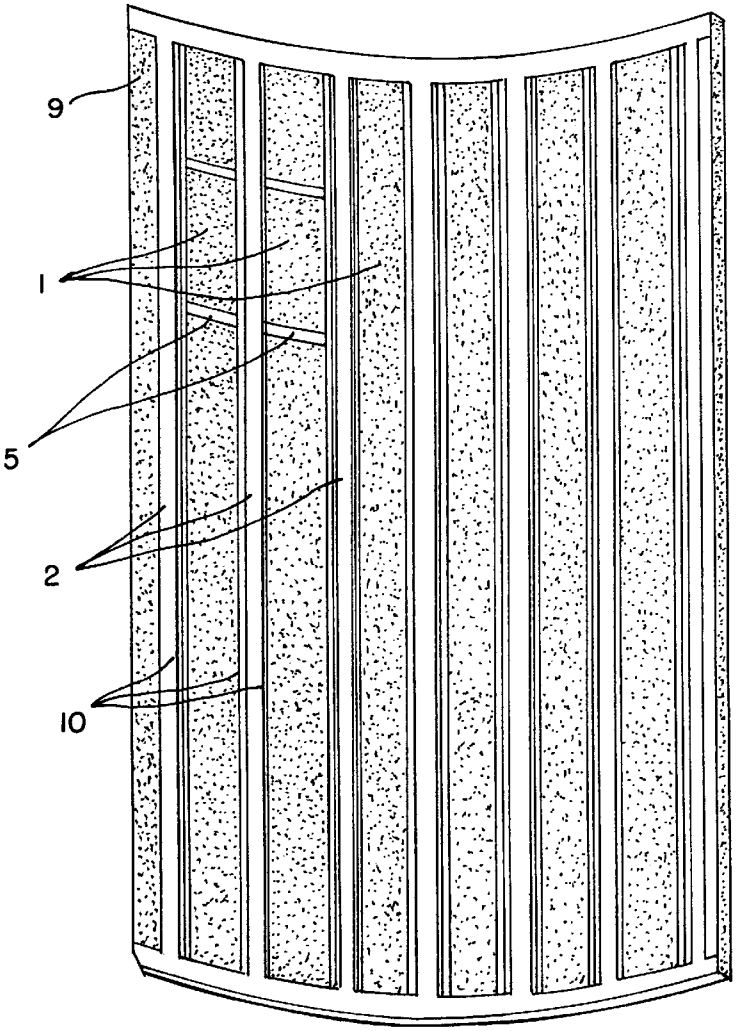
FIG. 5 shows schematically an enlarged part of the cylindric area as shown in FIG. 4.
Figure 4:
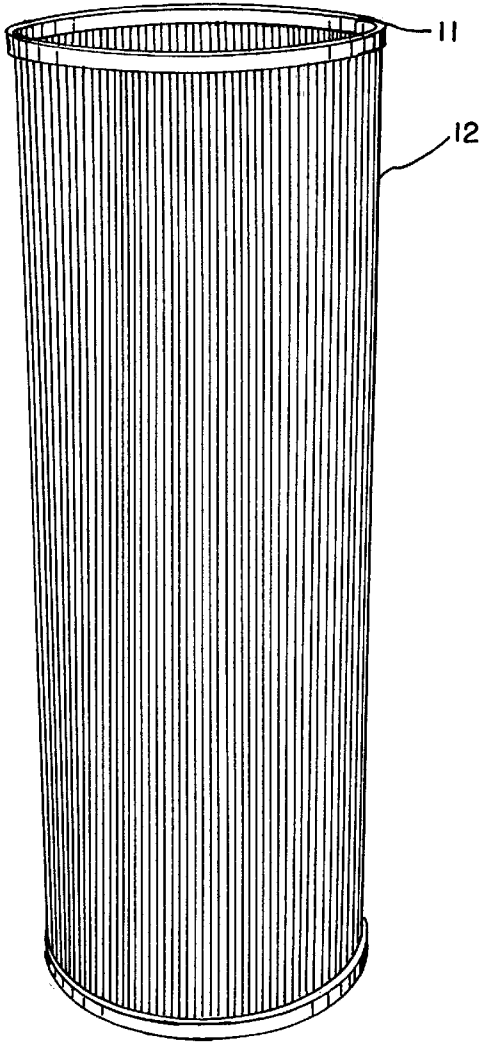
FIG. 4 shows a cylindric sound transmitter according to the invention.

A preferred embodiment of the invention is a cylinder as is shown in FIG. 4, constructed from end pieces 11 and an envelope surface 12 with a large number of sound producers of the type described above. The cylindric area may be constructed from modules 9 consisting of for example a half or a quarter of a circular arc as shown in FIG. 5, which otherwise is built as the plane module in FIG. 3. The diaphragms 1 are for example made up of approximately 10 mm wide strips of aluminium, which with air gaps 10 of approximately 0.15 mm between the adjacent magnetic bars 2 and the diaphragms are held in place by nylon clips 5. The aluminium strips can have a thickness of between 7–14 μm and are preferably wholly or partially folded to attain the appropriate elasticity lengthwise.

Figure 6:
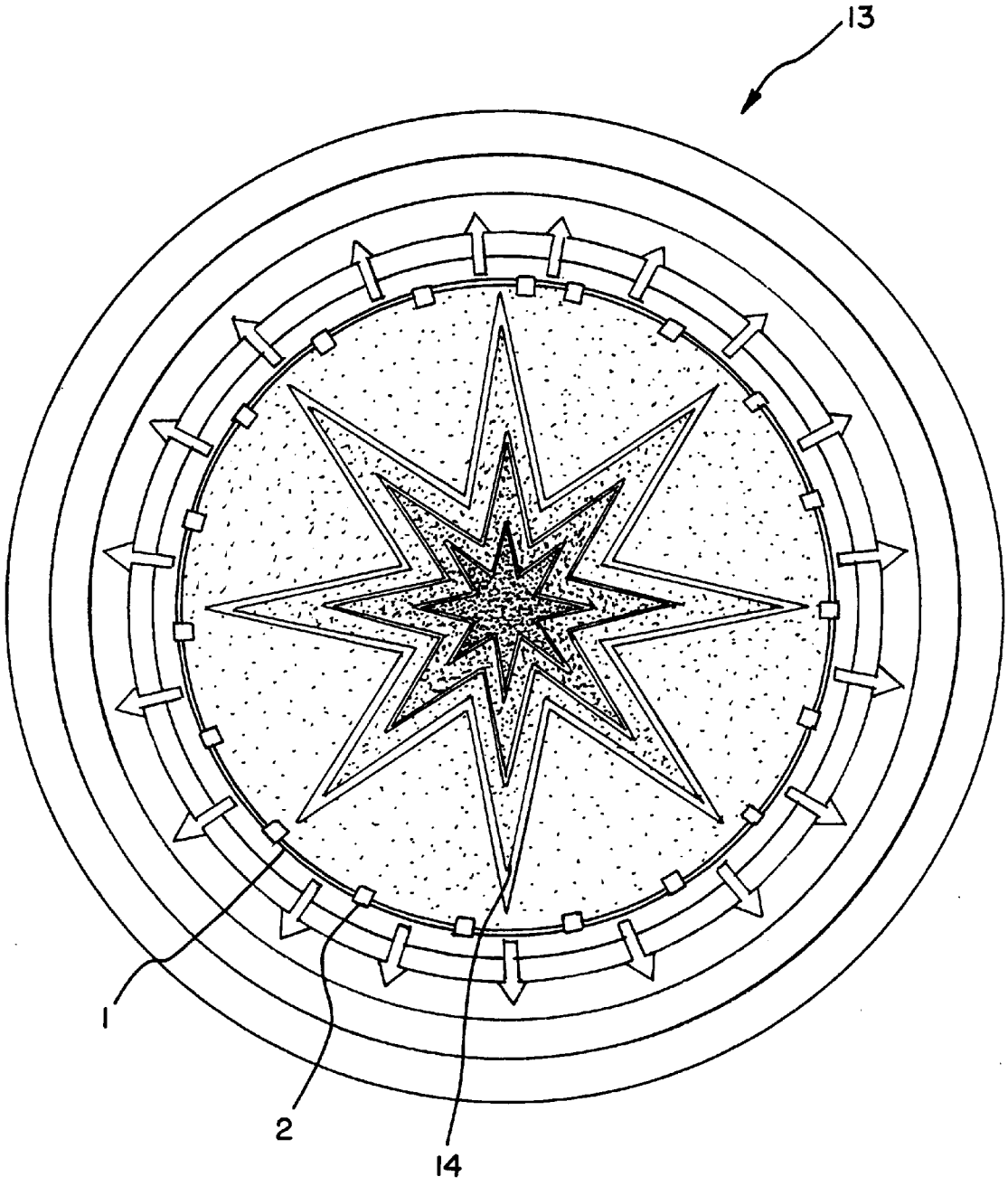
FIG. 6 shows a cross-section of the sound transmitter as shown in FIG. 4.

As shown in FIG. 6, the enclosed cylindric sound producer 13 is fitted with a noise-supressing material 14, which preferably has a star shaped cross-section and which, closer to the center of the cylinder, consists of a higher density material to achieve an efficient suppressing of sound towards the center of the cylinder, at the same time as a homogeneous sound field is extended radially outside the cylinder.

It is also possible to accomplish a widespread sound source according to the invention in the form of a truncated cone or part thereof, which would produce a suitable sound distribution when for example positioned in the center of the ceiling in for instance a large arrival hall. In order to accomplish this shape, the diaphragms and the gaps between the elongated magnet elements are made narrowing. It is also possible to construct the truncated cone from narrow and plane sound transmitters, each having a few diaphragms and elongated magnet elements.

To achieve a powerful directional effect, a special design can be made by using an omnidirectional cylinder mounted inside a cone shaped horn. The sound transmitting qualities thereby become analogous to those of a spotlight, i.e. a strong concentration of the transmitted sound energy may be achieved. The sound transmitter may in this way be regarded as a separate broad-band element in a horn-shaped casing. For lower energy levels, the omnidirectional cylinder may be replaced by a small number of line sources, whereby the horn is designed to obtain the desirable directional effect.

The above description of the invention has been made with reference to some preferable embodiments. Other designs are also possible and the patent is only to be limited by the wording of the patent claims.

What is claimed is:

1. An electro-acoustic transducer comprising:

first, second and third elongated magnet elements, said first, second and third elongated magnet elements having first, second, and third lengthwise directions which lie in approximately a single plane;

a first gap, lying in said single plane, between said first and second elongated magnet elements;

a second gap, lying in said single plane, between said second and third elongated magnet elements;

a first movable diaphragm, comprising an electrically conductive material, substantially filling said first gap;

a second movable diaphragm, comprising an electrically conductive material, substantially filling said second gap; and a current source connected to said first and second movable diaphragms to pass a current through said first and second movable diaphragms in a lengthwise direction, wherein each of said first and second movable diaphragms has a widthwise dimension, taken perpendicular to the lengthwise direction, which is equal to or greater than a width of each of said first, second, and third elongated magnet elements.

2. The transducer according to claim 1, wherein the widthwise dimension of each of said first and second movable diaphragms is at least twice the width of each of said first, second, and third elongated magnet elements.

3. The transducer according to claim 1, wherein the widthwise dimension of each of said first and second movable diaphragms is approximately 5 to 15 mm.

4. The transducer according to claim 3, wherein the widthwise dimension of each of said first and second movable diaphragms is approximately 10 mm.

5. The transducer according to claim 1, wherein said first and second movable diaphragms are constructed of aluminum.

6. The transducer according to claim 5, wherein said aluminum is folded.

7. An electro-acoustic transducer comprising:

first, second and third elongated magnet elements, said first, second and third elongated magnet elements having first, second, and third lengthwise directions which lie in approximately a curvilinear area which approximates a portion of a cylinder wall;

a first gap, lying in said curvilinear area, between said first and second elongated magnet elements;

a second gap, lying in said curvilinear area, between said second and third elongated magnet elements;

a first movable diaphragm, comprising an electrically conductive material, substantially filling said first gap;

a second movable diaphragm, comprising an electrically conductive material, substantially filling said second gap; and a current source connected to said first and second movable diaphragms to pass a current through said first and second movable diaphragms in a lengthwise direction.

8. The transducer according to claim 7, wherein each of said first and second movable diaphragms has a widthwise dimension, taken perpendicular to the lengthwise direction along the curvilinear area, the combined widthwise dimensions of the first and second movable diaphragms being equal to or greater than a combined width of said first, second, and third elongated magnet elements.

9. The transducer according to claim 7, further comprising a noise-suppressing material positioned inside the curvilinear area approximating the cylinder wall.

10. The transducer according to claim 9, wherein said noise-suppressing material has a cross-section corresponding to part of a star shape.

11. The transducer according to claim 9, wherein said noise-suppressing material has a star-shaped cross-section.

12. The transducer according to claim 7, further comprising:

a first end piece, first ends of said first, second and third elongated magnet elements, and first ends of said first and second movable diaphragms, being adjacent to said first end piece; and a second end piece, second ends of said first, second and third elongated magnet elements, and second ends of said first and second movable diaphragms, being adjacent to said second end piece.

13. The transducer according to claim 12, wherein said first and second end pieces are circular in cross section.

14. The transducer according to claim 12, further comprising:

first, second and third holders housing said first, second, and third elongated magnet elements, said first second and third holders connecting said first end piece to said second end piece.

15. The transducer according to claim 7, wherein said first, second and third elongated magnet elements are permanent magnets, with the poles oriented across the length of the permanent magnets.

16. The transducer according to claim 7, wherein said first and second movable diaphragms are constructed of aluminum.

17. The transducer according to claim 16, wherein said aluminum is folded.

* * * * *